US009731801B2

(12) United States Patent
Blenkarn et al.

(10) Patent No.: US 9,731,801 B2
(45) **Date of Patent: *Aug. 15, 2017**

(54) AIRBAG RESCUE SYSTEM

(71) Applicant: AMER SPORTS CANADA INC., North Vancouver (CA)

(72) Inventors: Michael Douglas Blenkarn, North Vancouver (CA); Thomas Walker Clarke Fayle, North Vancouver (CA); Gordon Thompson Rose, Bowen Island (CA)

(73) Assignee: AMER SPORTS CANADA INC., North Vancouver, British Columbia (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/010,851

(22) Filed: Jan. 29, 2016

(65) Prior Publication Data

US 2016/0144938 A1 May 26, 2016

Related U.S. Application Data

(63) Continuation of application No. 14/494,082, filed on Sep. 23, 2014, now Pat. No. 9,272,187, which is a (Continued)

(51) Int. Cl.
*B63C 9/08* (2006.01)
*A45F 3/04* (2006.01)
(Continued)

(52) U.S. Cl.
CPC ..... *B63C 9/081* (2013.01); *A45F 3/04* (2013.01); *A62B 17/00* (2013.01); *A62B 33/00* (2013.01); *A63B 29/00* (2013.01)

(58) Field of Classification Search
CPC B63C 9/00; B63C 9/081; A62B 17/00; A62B 33/00
(Continued)

(56) References Cited

U.S. PATENT DOCUMENTS 3,710,409 A 1/1973 Davidson
3,768,467 A 10/1973 Jennings
(Continued)

FOREIGN PATENT DOCUMENTS

EP 1 992 241 A1 11/2008
GB 1 590 604 A 6/1981
(Continued)

*Primary Examiner* — Lars A Olson
(74) *Attorney, Agent, or Firm* — Greenblum & Bernstein, P.L.C.

(57) ABSTRACT

The invention is directed to an airbag system and, more particularly, to such a system employed as a rescue or life-saving system to enable a person to survive an avalanche, for example. In a particular embodiment, the invention relates to an airbag system utilized with a backpack to be worn by a skier, snowboarder, hiker, or snowmobiler, for example. Instead of relying upon compressed gas cartridges or cylinders to inflate the airbag(s), the invention inflates the airbag(s) with ambient air only. In a particular embodiment, air is supplied to the airbag by means of a battery-powered electrical motor.

17 Claims, 6 Drawing Sheets

Related U.S. Application Data continuation of application No. 13/231,330, filed on Sep. 13, 2011, now Pat. No. 8,876,568.

(60) Provisional application No. 61/382,732, filed on Sep. 14, 2010.

(51) Int. Cl.

| | |
|---|---|
| ***A62B 17/00*** | (2006.01) |
| ***A63B 29/00*** | (2006.01) |
| ***A62B 33/00*** | (2006.01) |

(58) Field of Classification Search

USPC ..... 441/80, 91, 93; 116/209, 210

See application file for complete search history.

(56) References Cited

U.S. PATENT DOCUMENTS

| | | | |
|---|---|---|---|
| 4,008,983 | A | 2/1977 | Flatt et al. |
| 4,031,674 | A | 6/1977 | Rand |
| 4,246,672 | A | 1/1981 | Fujiyama et al. |
| 4,521,166 | A | 6/1985 | Phillips |
| 4,635,754 | A | 1/1987 | Aschauer et al. |
| 4,671,744 | A | 6/1987 | Shaffer et al. |
| 4,920,674 | A | 5/1990 | Shaeffer |
| 4,943,252 | A | 7/1990 | Manix |
| 5,293,707 | A | 3/1994 | Shaeffer |
| 5,599,041 | A | 2/1997 | Turnbull |
| 6,158,380 | A | 12/2000 | Aschauer et al. |
| 6,220,909 | B1 | 4/2001 | Aschauer et al. |
| 6,270,386 | B1 | 8/2001 | Visocekas |
| 6,676,467 | B1 | 1/2004 | Filsouf |
| 7,264,525 | B2 | 9/2007 | Tsitas |
| 7,270,077 | B2 | 9/2007 | Beck |
| 7,445,235 | B2 | 11/2008 | Makabe |
| 7,878,141 | B2 | 2/2011 | Paynton et al. |
| 8,123,581 | B2 | 2/2012 | Aschauer |
| 8,851,948 | B2 | 10/2014 | Grutta et al. |
| 8,876,568 | B2 | 11/2014 | Blenkarn et al. |
| 9,004,116 | B2 | 4/2015 | Walker et al. |
| 9,272,187 | B2 * | 3/2016 | Blenkarn ..... A45F 3/04 |
| 2001/0049840 | A1 | 12/2001 | Atanasio |
| 2006/0107952 | A1 | 5/2006 | Schlosser |
| 2007/0157925 | A1 | 7/2007 | ShterenBerg |
| 2008/0041906 | A1 | 2/2008 | Rose et al. |
| 2008/0257643 | A1 | 10/2008 | Weinel et al. |
| 2008/0282453 | A1 | 11/2008 | Alstin et al. |
| 2009/0239428 | A1 | 9/2009 | Berchten |
| 2010/0006176 | A1 | 1/2010 | Pansegrouw |
| 2010/0087112 | A1 | 4/2010 | Chou |
| 2010/0112880 | A1 | 5/2010 | Aschauer |
| 2010/0184343 | A1 | 7/2010 | Paynton et al. |
| 2010/0255809 | A1 | 10/2010 | Aschauer et al. |
| 2013/0145528 | A1 | 6/2013 | Gutta et al. |
| 2013/0145529 | A1 | 6/2013 | Gutta et al. |
| 2013/0146175 | A1 | 6/2013 | Walker et al. |
| 2013/0149923 | A1 | 6/2013 | Walker et al. |
| 2013/0149924 | A1 | 6/2013 | Walker et al. |

FOREIGN PATENT DOCUMENTS

| | | |
|---|---|---|
| JP | 2004-121794 | 4/2004 |
| JP | 2005-023814 | 1/2005 |
| JP | 2005-315085 | 11/2005 |
| JP | 2006-123736 A | 5/2006 |
| JP | 2006-518424 | 8/2006 |
| JP | 3152441 | 7/2009 |
| WO | 2004-017773 | 3/2004 |
| WO | 2006-068072 | 6/2006 |
| WO | WO 2010/085576 A1 | 7/2010 |

* cited by examiner

AIRBAG RESCUE SYSTEM

CROSS-REFERENCE TO RELATED APPLICATIONS

This application is a continuation under 35 USC §120 of nonprovisional U.S. patent application Ser. No. 14/494,082, filed Sep. 23, 2014, which is a continuation of nonprovisional U.S. patent application Ser. No. 13/231,330, filed Sep. 13, 2011, which claims the benefit under 35 USC §119(e) of U.S. provisional patent application No. 61/382,732, filed Sep. 14, 2010. The disclosures of both of the aforementioned applications are hereby incorporated by reference thereto in their entireties.

BACKGROUND

1. Field of the Invention

The invention relates to an airbag system and, more particularly, to an airbag rescue or safety system and, even more particularly, an airbag system employed as a life-saving system to enable a person using such system to survive an avalanche, or analogous situation, such as a water rescue, e.g., as well as an airbag system for attachment to, and for recovering, equipment of the person, such as a snowmobile.

More particularly, such a system can be used when activated (either remotely or manually by the user) to maintain the user or the user's equipment buoyant during an avalanche, or analogous situation, and to maintain the user or equipment on the surface of the avalanche, or as close to the surface as possible, thereby enabling the user to survive the avalanche or to facilitate recovery of the user's equipment.

In a further particular implementation, the field of invention relates to an airbag system utilized with a harness or backpack to be worn by a skier, snowboarder, snowmobiler, hiker, or a person engaged in another activity, who risks being exposed to an avalanche or analogous situation. In this regard, the invention also relates to a system attachable to an item of gear, such as a snowmobile or other sports gear, for example, which system can be remotely activated.

2. Background Information

Currently, so-called avalanche airbags, embodied as backpack systems to be worn by a skier, include those marketed by ABS Peter Aschauer GmbH, Snowpulse S.A., and Backcountry Access, Inc. Such systems are disclosed in the following documents: U.S. Pat. Nos. 4,635,754; 6,158,380; 6,220,909; U.S. Patent Application Publication No. 2009/0239428; U.S. Patent Application Publication No. 2010/0112880; and U.S. Patent Application Publication No. 2010/0184343.

These systems are designed to prevent burial in an avalanche and to enable the victim to survive an avalanche with the fewest possible injuries when wearing a backpack which incorporates such a system. These systems are intended to have the wearer stay on the surface of the avalanche or as close to the surface as possible.

In this regard, after activation and inflation, the inflated airbag secured to the victim increases the combined volume compared to the volume of the victim without such a system, thereby having the effect of keeping the victim at or near the surface of the flow of the snow during an avalanche. Further, sufficiently reducing the combined weight/volume ratio of the victim wearing an inflated airbag, i.e., to less than that of the snow, maintains the victim relatively buoyant and at the surface of the snow.

When activated, the ABS avalanche airbag deploys a pair of vertically elongated airbags on the sides of the back of the wearer, whereas the Snowpulse system deploys an airbag that surrounds the wearer's head. ABS claims that the unobstructed vision and freedom of movement, even with the inflated airbags, allow the wearer to escape an avalanche and make it possible to react when caught in an avalanche and to assume a protective position. The single-bag system of Snowpulse is designed to provide protection to the head and thorax of the wearer which, in addition to providing protection against burial, also protects against traumas. In either case, the system is intended to maintain the wearer at or near the surface of the avalanche and is not dependent solely on a rescue or avalanche beacon. ABS claims that 98% of all avalanche victims who activated their ABS avalanche airbag have survived, while 90% of this group were completely uninjured.

The aforementioned U.S. Patent Application Publication No. US 2010/0184343 of Backcountry Access, Inc. describes in detail the current related art of avalanche airbag backpacks and gives a history and general description of the construction, use, and intent of this category of equipment.

Each of the systems known in this field of technology, including the aforementioned systems of ABS, Snowpulse, and Backcountry Access, Inc., relies upon a one-time use container of compressed gas (such as air or nitrogen) to inflate the airbag(s). Some of these one-time use systems also incorporate a means of drawing in ambient air to increase the total volume of gas by means of a venturi or an ejector, but such means nevertheless require the compressed gas for drawing in the ambient air.

Despite the success and advantages offered by avalanche airbags known in the art, many problems are inherent with the use of compressed gas containers, i.e., cylinders and cartridges. For example, compressed gas systems are limited by their one-time use. Once the compressed gas is expelled, a new cylinder or cartridge must be installed or the empty one refilled prior to re-use.

In addition, due to size and weight constraints of compressed gas cylinders/cartridges, the available volume to which the airbag is inflated is limited during release of the compressed gas.

Further, systems employing compressed gas cylinders/cartridges are additionally adversely affected by the weight of such systems. This problem is acknowledged in each of the aforementioned U.S. Patent Application Publication No. 2010/0184343 and U.S. Pat. No. 6,220,909. The solution offered for these systems however, is a reduction in the amount of pressurized gas required for inflating the airbag(s), thereby enabling the use of a smaller compressed gas cylinder. The smaller cylinder, then, results in a reduction of the weight of the system.

Further, the use of compressed gas cylinders/cartridges are adversely affected by legal and safety issues related to transporting them via aircraft and other commercial vehicles. In fact, manufacturers of avalanche systems warn that tampering with such cylinders/cartridges can life-endangering.

Still further, logistical delays involved with re-filling compressed gas cylinders/cartridges present an additional inconvenience or constraint on their use.

Likewise, restrictions on shipping, mailing, transporting, importing and exporting, and certifying compressed gas cylinders/cartridges provide additional constraints and inconvenience.

Particularly in view of the one-time use of compressed gas cylinders/cartridges, their use in training and demonstration purposes is particularly limited, inasmuch as for each deployment a new or re-filled cylinder or cartridge is required.

In addition, compressed gas containers inherently give rise to potential safety issues for the known systems. For example, manipulation at the closure or at the container can trigger an explosion, creating a risk of injury and death, even for bystanders. Further, for their systems, ABS and Snowpulse explain that only original containers provided by them are to be used and that empty containers are to be refilled at their shops. An advisory for use of such containers explains that each supplied container has a sticker, giving its total weight and the date of filling, and that readiness for use can only be assured by weighing the container again and comparing it to the weight written on the sticker.

The aforementioned U.S. Pat. No. 6,220,909 discloses a compressed gas system whereby the gas release grip mechanism is made detachable with respect to the compressed gas unit so as to avoid an unintentional or erroneous triggering causing inflation of the airbags. In this way, the release grip is not hooked up to the compressed gas unit—which must then be accomplished prior to use, such as during skiing or hiking—while the user is on a mountain cableway, on a train, in a restaurant, on a bus, or on a trail, e.g., prior to intended use. Of course, the user must then remember to re-connect the system before he begins skiing, snowboarding, or hiking, for example, i.e., where an avalanche condition is a possibility.

SUMMARY

The present invention relates to an airbag system which overcomes all of the aforementioned negative aspects of compressed gas systems.

More particularly, the present invention is directed to an airbag system which includes an inflation device using 100% ambient air to inflate the airbag(s). Therefore, not only does the invention use less compressed gas than known rescue systems, no compressed gas is used. That is, the system of the invention utilizes no compressed gas cylinder or cartridge, i.e., no compressed gas container. Instead, inflation of the airbag(s) is achieved with an electrically powered device.

Nevertheless, a system according to the invention can achieve airbag inflation times of under 5 seconds at −20° C., and, more particularly, inflation can be achieved in as little as 2½ seconds at −20° C.

Rather than inflation being provided by the release of gas from a compressed air cartridge or cylinder, the invention utilizes inflation provided by an electric power source, such as an electric motor. The electric motor can be either a brushed or a brushless direct current electrical motor, the latter being either of the inrunner or the outrunner configuration, with digital control.

To these and other ends, the invention provides for an airbag system, such as for rescue in snow or water, that includes:

at least one inflatable airbag having an inflated state and a deflated state;

a powered air mover that includes a bladed rotor; an electric motor for rotating the bladed rotor to move air to inflate the at least one airbag; and a supporting device designed to support the airbag and the electric motor on a user of the airbag rescue system or on equipment used by the user, whereby, in the deflated state, the supporting device is structured and arranged such that the airbag is positioned within the supporting device and, in the inflated state, the airbag is structured and arranged to extend externally beyond the supporting device for engagement with the snow or the water.

In a particular embodiment, the supporting device is or comprises a backpack having shoulder straps, the backpack supporting at least the airbag and the electric motor and, in the deflated state, the airbag is contained within the backpack.

In a particular embodiment, such as one in which the supporting device is a backpack, though in another embodiment having a different supporting device, one or more ambient air intakes are positioned on an outer surface of the supporting device. In a more particular detailed embodiment, ambient air intake ducting is positioned to channel ambient air from the ambient air intake(s) to the bladed rotor. In an embodiment in which the supporting device is a backpack, a pair of ambient air intakes can be spaced apart on an outer surface of the backpack and ambient air intake ducting can be positioned to channel ambient air from both of the pair of ambient air intakes to the bladed rotor.

According to embodiments of the invention, the bladed rotor and the electric motor are components of a means for inflating the at least one airbag with 100% ambient air to a volume of at least 100 liters in no more than 5 seconds.

Still further, embodiments of an airbag rescue system of the invention include neither a compressed gas container nor a source of compressed gas.

In a particular embodiment, in the inflated state the airbag includes at least a portion that is positioned proximate the user's head and at the height of the user's head.

In a particular embodiment, the powered air mover further comprises a battery connected to the electric motor for powering the electric motor for rotating the bladed rotor. The battery, according to a particular feature of an embodiment, weighs a fraction of a pound, such as 98 grams. In addition, the supporting device can be configured to support the battery as well as the electric motor and the airbag.

In such an embodiment, in addition to the battery, the powered air mover includes a controller connected to the battery and the electric motor, with the controller configured to control power to the electric motor.

Still further, in such an embodiment, a manual activation switch is provided in communication with the controller, the switch being configured to be manipulated by the user and, via the controller, selectively switches power to the electric motor between off and on states.

For example, according to a particular embodiment, the controller is configured to cycle power from the battery to the electric motor in successive predetermined spaced-apart time intervals.

Also, according to a particular embodiment, the controller is configured to cycle off power from the battery to the electric motor in response to air pressure within the airbag having reached a predetermined limit sensed by an air pressure sensor.

According to a particular embodiment, the supporting device comprises a backpack having an upright panel configured to be supported against a user's back and, in the inflated state, the at least one airbag extends forwardly of the upright panel.

According to a particular non-limiting feature of the invention, in the inflated state, the at least one airbag is configured to extend at a height of the user's head on both sides of the user's head.

According to another particular non-limiting feature of the invention, the supporting device comprises a backpack, and the powered air mover is substantially centered, left-to-right, in relation to the backpack.

According to yet another particular non-limiting feature of the invention, the supporting device comprises a backpack, and the backpack includes a main compartment for housing the airbag in the deflated state, in addition to other pockets.

According to yet another particular non-limiting feature of the invention, in the inflated state, the at least one airbag has a volume that extends at least mostly above the powered air mover.

Further, in a particular embodiment of the invention, the invention provides for an airbag rescue system that includes:

at least one inflatable airbag having an inflated state and a deflated state;

a powered air mover;

a manual activation switch configured to be manipulated by the user and to selectively switch power to the powered air mover between off and on states; and a supporting device designed to support the at least one inflatable airbag and the powered air mover on a user of the airbag system or on equipment used by the user;

in the deflated state, the supporting device being structured and arranged such that the at least one airbag is positioned within the supporting device;

in the inflated state, the at least one airbag being structured and arranged to extend externally beyond the supporting device.

Still further, in a particular embodiment, the invention provides for an airbag rescue system that includes:

at least one inflatable airbag designed to having an inflated state and a deflated state;

a powered air mover that includes a bladed rotor; an electric motor for rotating the bladed rotor to move air to inflate the airbag; a battery connected to the electric motor to power the electric motor for rotating the bladed rotor; a controller connected to the battery and the electric motor configured to cycle off power from the battery to the electric motor upon attaining a predetermined upper air pressure limit within the airbag sensed by an air pressure sensor, and to cycle on power from the battery upon attaining a predetermined lower air pressure limit within the air bag sensed by the air pressure sensor; and a wearable device, such as a backpack, designed to be worn by a person, the wearable device supporting at least the inflatable airbag and the electric motor.

Still further, in a particular embodiment, the invention provides for an airbag rescue system that includes:

an inflatable airbag having an inflated state and a deflated state whereby, in the inflated state the airbag has a volume of at least 100 liters;

a backpack having a pair of shoulder straps and a compartment within which the inflatable airbag, at least in the deflated state, can be supported;

an ambient air intake extending through a surface of the backpack, the air intake being configured to receive ambient air from outside of the compartment of the backpack; and an electrically powered air mover configured, in relation to the airbag and the backpack, to draw in the ambient air through the air intake and to propel the ambient air toward the airbag to bring the airbag to the inflated state, and, in the inflated state, the airbag being structured and arranged to extend externally beyond the backpack for engagement with the snow or the water.

The electric power source further includes a power supply, whereby power is supplied to the motor by any of a number of options, including rechargeable batteries, disposable batteries, fuel-cells, or solar energy. For example, lithium-polymer (LiPo) batteries are suitable. In a particular embodiment, a heated battery or a self-heated battery can be employed in the invention. In this regard, the battery selected for use can be merely insulated for the conditions/temperatures of use. In another embodiment, a self-heating battery pack can be employed. In this regard, as exemplary, a self-heated battery can take the form of (1) the battery running a small secondary resistance heater controlled via a thermostat, or (2) a battery that charges and discharges to a capacitor, or similar component, and generates heat through the internal resistance and endothermic nature of the battery. The control can range from a thermostat to a solid-state circuit with a thermocouple or even monitoring the actual battery output potential and/or internal resistance.

Further, control of the motor and electrical power supply can be achieved by digital controllers of various types (voltage, heat, pressure, time, current, cycles, RPM, remote triggering via radio, etc. can all be controlled electronically). Optionally, a gyroscopic or other attitude-sensing switch can be employed to enable emergency/automatic activation of the motor (and inflation of the airbag(s)) upon sensing an extreme upset condition of the wearer, or piece of equipment supporting the system of the invention, such as a "head-over-heels" tumbling, e.g., optionally coupled with a time duration delay to avoid inadvertent activation. Such a switch, if employed, could be fitted with a manual cut-out switch to allow the wearer, or operator, to activate such automatic operation only prior to avalanche-prone areas or otherwise only in situations determined by the wearer or operator.

The ambient air is moved into the airbag and pressurized by means of any one of, or a combination of, air-movement devices including, but not restricted to the following: a ducted fan blower; a rotary or centrifugal fan/compressor; an axial fan/compressor (turbine); a rotary vane pump/blower/compressor; a gear pump; a squirrel-cage blower/fan.

The aforementioned devices can all be used in single or multi-stage configurations, as well as in series or parallel configurations, as well as in combinations of the different types of devices to create the specific volumes, fill-rates, and pressures of air as needed for specific airbag applications.

The weight of a system according to the invention, compared to the weight of known compressed gas systems, can be reduced by as much as 50% for equivalent amounts of inflation volume and pressure.

The system can deliver continuous and very high volume and pressure of gas dependent on the electrical supply which can easily be increased or decreased as required. A system according to the invention can be deployed as many as 50 times or more between battery charges.

The airbag system of the invention is not limited to a particular shape of the airbag itself. Instead, the invention can be implemented with airbags of any known shape and, for a given system, either one, two, or more airbags can be used. The total volume would be within a range of approximately 150-300 liters for an airbag system for personal use, such as being attached via a harness system, such as a backpack.

The specific intended uses of an airbag system according to the invention are for personal protection in a wearable backpack configuration, and also for equipment flotation (such as for snowmobiles, etc.). In the latter case, the system can be made to be remotely activated. The airbag system of the invention can be incorporated into various forms of support for the various components of the system to be applied to or worn by a person or an item to be rescued. For example, such support can take the form of a frame or harness, such as that utilized as part of a backpack, or as part of a climbing harness, or as part of an article of clothing, such as a jacket, a vest, a coat, or other item of apparel. In this regard, the expression "supporting device" can be used to reference any such apparatus that allows components of the airbag system of the invention to be worn by or applied to a person or item to be rescued. For recovery of a piece of equipment, rather than as a personal device, the airbag volume can be adjusted accordingly. For a snowmobile, which might be generally four times the weight of a person, the airbag volume could be within the range of 500-1000 liters.

In general, the invention encompasses an airbag device, such as those described in aforementioned patent documents, but in which the compressed air source and associated components required for inflation via compressed air, according to such known systems, which are replaced with an electrically powered air supply device and necessary components, described herein, with the aforementioned advantages resulting from not utilizing such compressed air source and various components required for implementation of compressed air systems. To this end, therefore, the disclosures of the aforementioned patents and patent applications are hereby incorporated by reference thereto in their entireties. In addition, although the airbag device is applicable to survival and rescue from an avalanche, i.e., rescue situations while on snow, the airbag system of the invention also has applicability to rescue situations on water, such as after a boat or other watercraft capsizes or otherwise loses its buoyancy.

BRIEF DESCRIPTION OF DRAWINGS

Other characteristics and advantages of the invention will become apparent from the description which follows, with reference to the annexed drawings which are provided only by way of non-limiting examples, and in which.

DETAILED DESCRIPTION

The following detailed description is that of particular embodiments, including exemplary structures, materials, and arrangements of parts, as well as exemplary methods. However, it is to be understood that this description is presented for the purpose of enhancing an understanding of the invention and not to limit it to such particular embodiments and methods.

Figure 1:
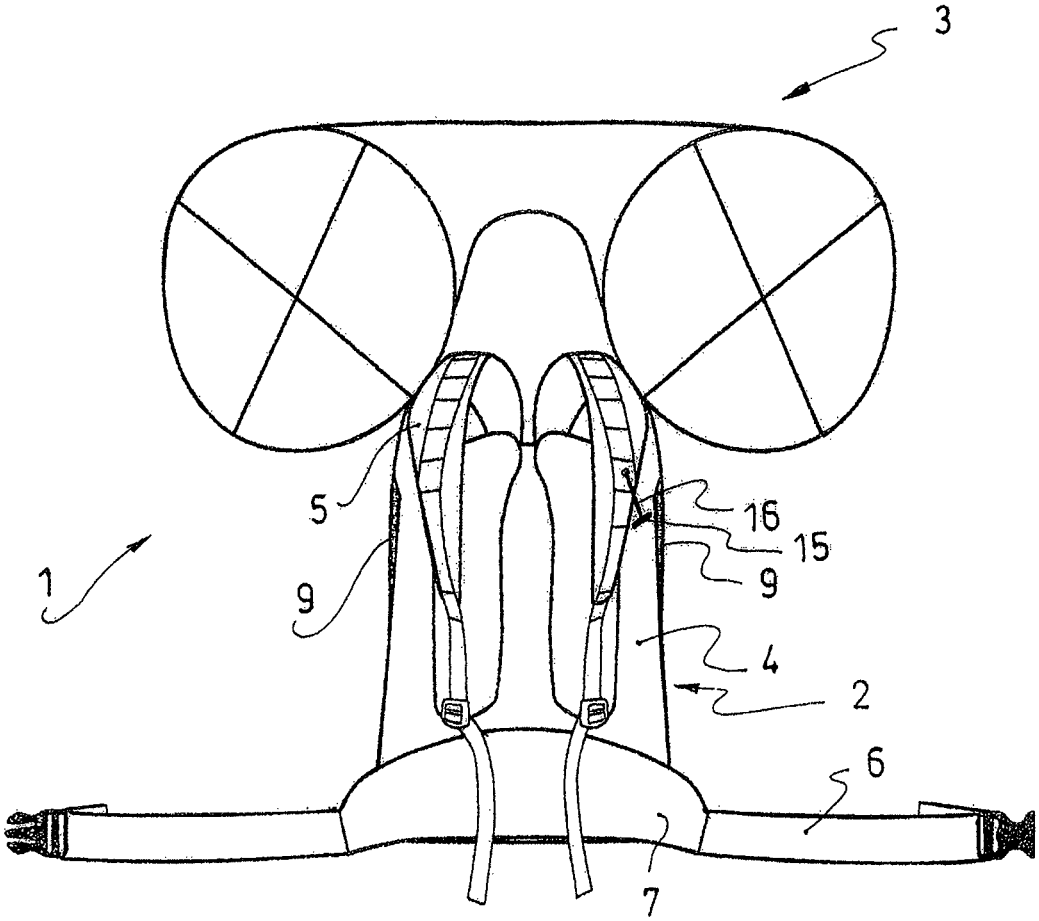
FIG. 1 is a schematic front view of backpack with which an airbag system according to the invention is incorporated, showing an airbag of the system in an inflated, deployed configuration.
Figure 2:
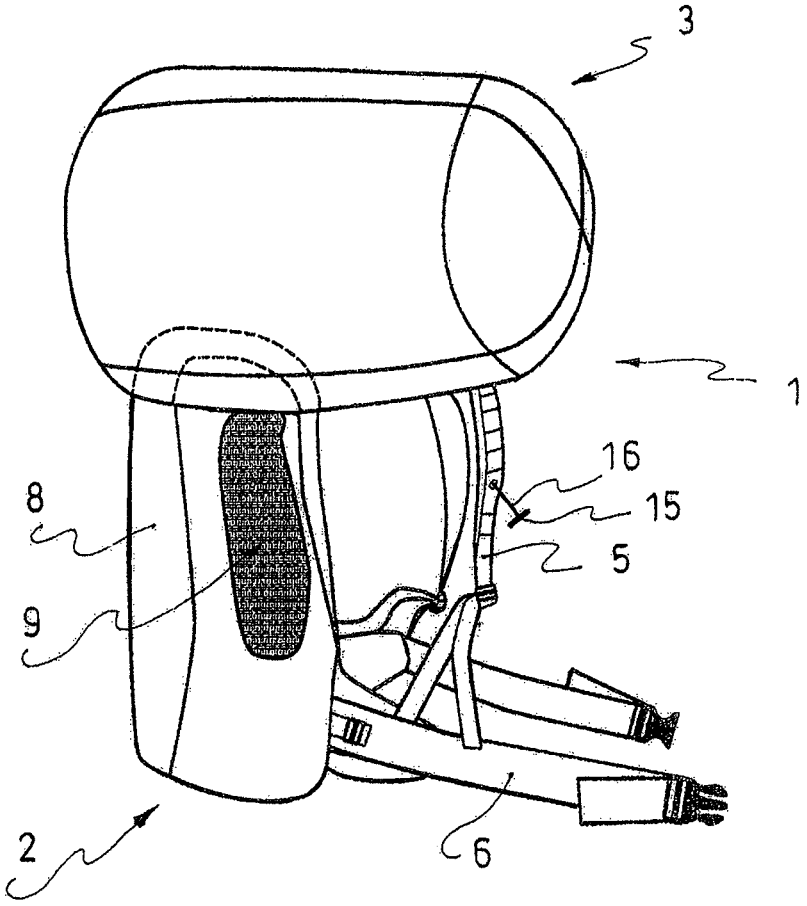
FIG. 2 is a side view of the backpack and airbag system of FIG. 1.

FIGS. 1 and 2 illustrate an airbag system 1 according to the invention, incorporated with a backpack 2, with an airbag 3 in a deployed, i.e., inflated, configuration.

The backpack provides a structure for supporting various components of the airbag system, as further described below in connection with FIGS. 3 and 4. The backpack includes an upright panel 4, adapted to lie against the back of the wearer, to provide rigidity to the backpack and support for components of the airbag system, as well as a pair of shoulder straps 5 and a waist belt 6, both with adjustable coupling elements, and a pad 7 for support against the lower back of the wearer. A backpack such as that disclosed in commonly assigned U.S. Patent Application Publication No. 2008/0041906, the disclosure of which is hereby incorporated by reference thereto in its entirety, having an upright panel (referred to therein as a sheet frame 42, e.g.), could be utilized in the invention to support certain components thereof.

The backpack 2 can include a main compartment and various pockets like those of conventional backpacks. Alternatively, rather than comprising such attributes of conventional backpacks, only those components necessary for supporting the various components of the airbag system can be utilized. Thus, rather than having the airbag system incorporated into a backpack that has utility beyond merely supporting the airbag system, it is to be understood that the invention can be incorporated with what can be characterized as merely a supporting device, such as a harness. In this regard, therefore, the supporting device can be devoid of a main compartment and various pockets, e.g., although it can include a compartment, such as compartment 8, for storing the airbag 3 prior to inflation, in which case the supporting device could thereby be regarded as a backpack of a specialized type.

In alternative embodiments, not shown, the airbag system of the invention can be incorporated with any of various articles of clothing, such as jackets or vests, for example. That is, such articles of clothing can have incorporated therein various supporting devices for the components of the airbag system.

Although not shown with further particularity, the uninflated airbag(s) can be stored in compartment 8, prior to activation, and released from the compartment upon inflation of the airbag(s), in the manner of the systems disclosed in the aforementioned patents and publications, such as U.S. Pat. No. 6,158,380 and U.S. Patent Application Publication No. 2010/0184343, for example, the disclosures of such patents and publications being incorporated by reference thereto for this purpose.

To facilitate inflation of the airbag with 100% ambient air, at least one of the sides of the backpack includes a screen or ventilated panel 9 to enable the ambient air to be drawn in.

Figure 3:
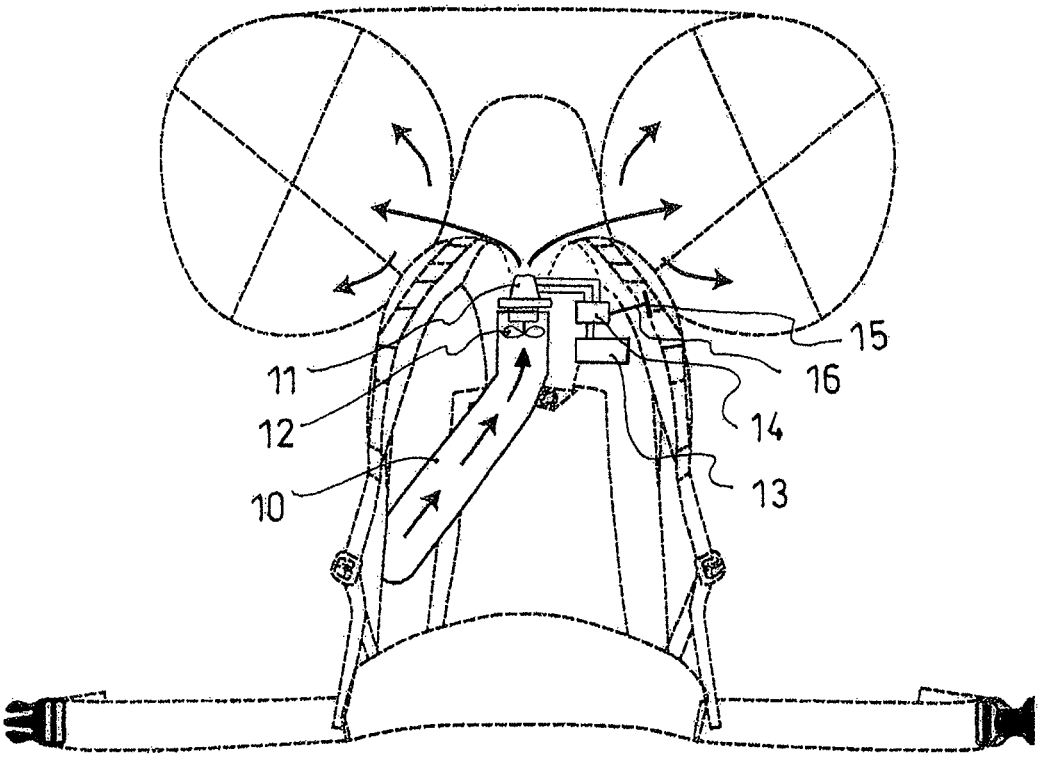
FIG. 3 is a view similar to that of FIG. 1, illustrating components of the airbag system of the invention which are incorporated into the backpack.
Figure 4:
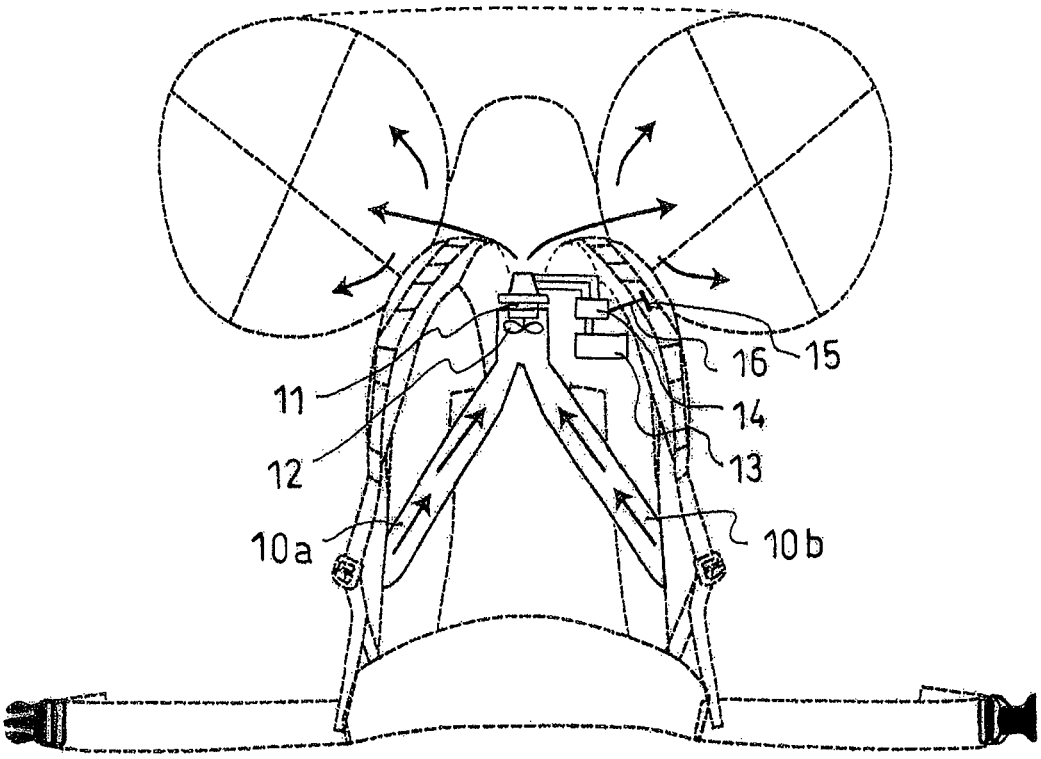
FIG. 4 is a view like that of FIG. 3, illustrating an alternative embodiment.

FIGS. 3 and 4 schematically illustrate components of a particular embodiment of an airbag system according to the invention. Details of the airbag itself, deployed as in FIGS. 1 and 2, as well as the backpack, are depicted in broken lines.

FIG. 3 illustrates a conduit 10, or intake ducting, providing an ambient air passageway for channeling air from the intake, such as through the ventilated panel 9, to an output, the latter opening at the airbag 3 for inflation. Alternatively, rather than a single conduit, a pair of such conduits, or intake ducting, such as conduits 10*a*, 10*b* in FIG. 4, can be employed, pulling in ambient air from respective ones of a pair of spaced-apart intakes 9 positioned on respective ones of the sides of the backpack. The conduit(s) 10 or 10*a*, 10*b*, can be mounted on, or can be supported by, the panel 4 of the backpack, with the air intake, i.e., vent 9, being positioned on an outer surface of the backpack or harness, as shown in the drawing figures.

Proximate the output end of the conduit 10 in FIG. 3, or at the junction of the conduits 10*a*, 10*b*, proximate the output end thereof, in FIG. 4, an air movement device that includes, e.g., a fan, such as a rotor having a plurality of blades, is positioned within the conduit for drawing in ambient air from the intake and pushing the air through the output for inflating the airbag 3.

The invention encompasses other forms of air movement devices for achieving the objectives of the invention, particularly that of fully inflating an airbag volume (such as at least 150 liters or more) within a predetermined time period (such as no greater than five seconds, or less). For example, a ducted fan blower, a rotary or centrifugal fan/compressor, an axial fan/compressor (turbine), a rotary vane pump/blower/compressor, a gear pump, and a squirrel-cage blower/fan are all possibilities within the scope of the invention.

Further, in this regard, the fan/blower/compressor (i.e., generally referred to here as an "air movement device" or a part of such device) can be a single or a multi-stage configuration. To achieve higher pressures or a stronger draw of ambient air (if required based upon the application), multi-stage blowers in series, e.g., can be used (as with axial turbine compressors or two centrifugal vacuum cleaners). To achieve higher flow/fill rates or redundancy for safety, parallel systems can be used. A combination of two types of blowers also can be used (such as a rotary vane pump for high pressure for initial airbag deployment used with an axial ducted fan for very high volume air movement).

With further reference to the illustrated embodiment, the air movement device (hereafter "fan," for convenience) is powered by an electric motor 11, such as an inrunner or outrunner brushless DC motor, the fan 12 being positioned within a conduit proximate the output end thereof, with the fan being mounted on the output shaft of the motor. In the illustrated embodiment, the motor 11 is positioned downstream of the fan 12. Alternatively, the motor can be mounted exteriorly of the conduit, supported on the panel 4 of the backpack, with a right-angle drive that couples the shaft of the fan with the output shaft of the motor or, in the case of an inrunner brushless motor, with the fan mounted on the output shaft of the gearbox which is mounted to the motor. The invention encompasses other types of electric motors, as well, which are suitable for achieving the objectives of the invention. More particularly, FIGS. 3 and 4 schematically illustrate an outrunner brushless DC motor 11, with a fan 12 mounted on its output shaft.

Also supported proximate the motor and fan, and wired to the motor, is the electric power supply, in the form of a battery 13, such as of the lithium-polymer (LiPo) type, and a controller 14, such as that which provides digital control. The invention encompasses other forms of power supply and control for achieving the objectives of the invention, including, e.g., a heated or self-heated battery.

Although the airbag illustrated in the drawings, such as in FIGS. 1 and 2, is positioned at the height of the head of the wear and extends from the rear and along both sides of the head, the invention is not limited to such particular shape and can be suitably practiced with other shapes. In addition, although a single airbag is shown, the invention can be suitably practiced with a pair of airbags, as disclosed, e.g., in U.S. Pat. No. 6,158,380 and other documents, or more than two airbags.

Further, the total volume of the airbag 3 could be approximately 150 liters, although the volume can be larger if desired, such as within a range of approximately 150-300 liters, inasmuch as there would not appear to be a large penalty, such as an additional increment of weight of the system, for utilizing airbag(s) with a larger volume.

On at least one of the shoulder straps, a trigger 15, or activation switch, is positioned, such trigger being coupled to the controller 14 via wire 16 (see FIGS. 3, 4). The trigger can be any of several types, requiring a push, a pull, a twist, or other manipulation for initiating the electrical activation of the system and the inflation of the airbag(s). In certain embodiments encompassed by the invention, the trigger has a size and shape that particularly facilitates manipulation with a gloved hand. The wired electrical connection 16, extending between the trigger 15 and the controller 14, either along or within the structure of the strap to which the trigger is mounted.

In operation, when the wearer (skier, hiker, snowmobiler, e.g.) becomes aware of an avalanche situation, he/she manipulates the trigger 12, resulting in a signal being sent to the controller 14, thereby powering the motor 11 to begin rotation of the fan 12, for drawing ambient air through the passageway(s) 10 or 10*a*, 10*b*, to the output, for inflation of the airbag 3.

According to a particular embodiment of the invention, the fan pumps ambient air into the airbag for a predetermined time. For fully inflating a 150-liter airbag, the "on" signal from the controller to the motor could be transmitted for at least five seconds. Alternatively, for safety reasons, the fan could be powered for a longer duration, i.e., greater than a calculated full-inflate time, greater than five seconds, i.e., such as 10-15 seconds or more, for the aforementioned 150 liter airbag. This could accommodate variations in ambient conditions, such as including variations in temperature and pressure, which could affect a predetermined full-inflate time.

In a simplified embodiment according to the invention, the airbag system includes, in addition to the airbag(s), an air movement device (such as a fan), an electric motor, a power source (including a battery, for example), and an on/off switch, whereby, when the wearer becomes aware of an avalanche, the switch is manipulated, thereby powering the motor, which turns the fan until the power source is depleted or until the wearer were to move the switch to the off position.

In an enhanced embodiment, e.g., the airbag system of the invention can include an air pressure sensor to monitor pressure within the airbag, whereby the motor would be signalled to cycle off power to the fan upon attaining a predetermined pressure. In fact, each of the aforementioned time cycles for inflation (i.e., five seconds, or 10-15 seconds, e.g.) and the pressure-sensed power-control for inflation could be used separately in respective embodiments, or in combination. In the latter case, e.g., the pressure sensing could be used as a cut-off for a time-dependent system, whereby power would be interrupted before the end of the time duration if pressure reaches a set level.

In any case, the invention encompasses the alternate cycling of power to the fan, i.e., on and off, after an avalanche but prior to recovery, either as a function of a set time interval or as a function of an airbag pressure drop below a set level. This feature, of course, is unavailable with known systems that rely upon a one-time-use compressed gas container to inflate the airbag(s). Further, in this regard, modern battery technology, including LiPo batteries, e.g., enables multiple airbag deployments between charges.

In yet an additional enhanced embodiment of the invention, the airbag is fitted with an overflow valve (or pressure-relief valve), so that the fan (or blower or compressor) delivers breathable air to the vicinity of the user's head. In this regard, such a valve supplies breathable air continuously or in incremented cycles, whereby the fan is cycled on and off, as long as the power supply is not depleted. The overflow air could be delivered manually by the wearer by means of an appropriate control member positioned near the trigger, e.g., and/or automatically (for safety reasons, inasmuch as the wearer might be in an incapacitated state), such as by means of an appropriate control algorithm.

For the aforementioned enhanced embodiment, the supply of breathable air, post-avalanche, would be drawn in via the intake vents/screen(s) 9, particularly if either side of the backpack, and vents/screen(s) 9, are exposed, or from the snow-pack.

Figure 5:
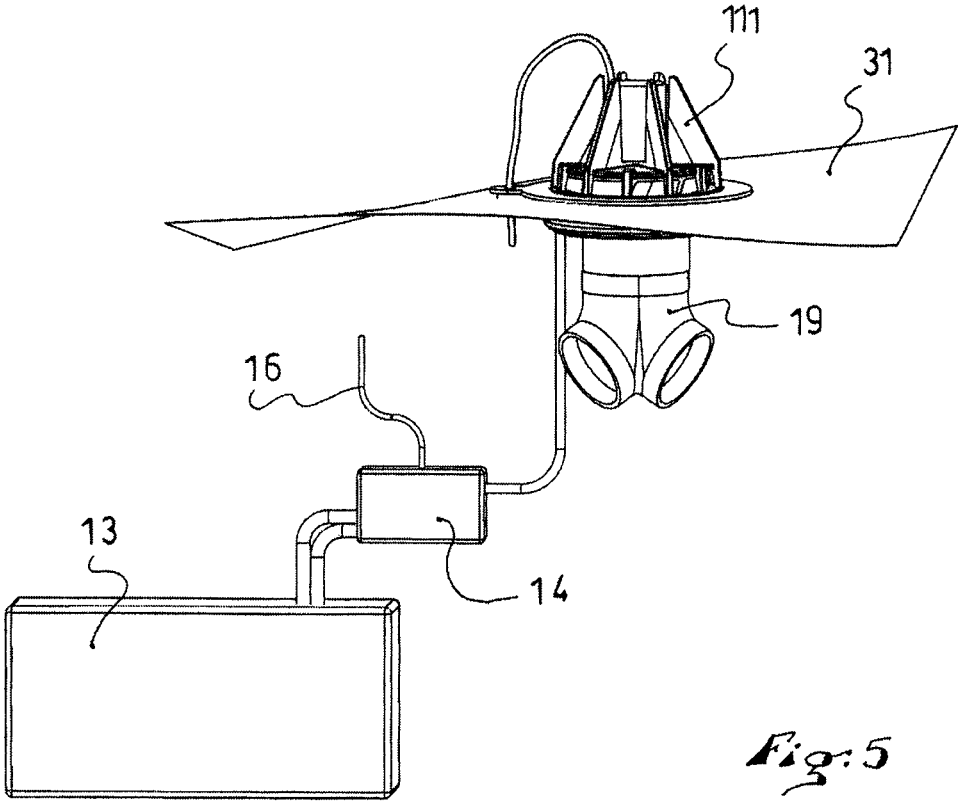
FIG. 5 is a schematic view of an assembly of components mounted to an airbag, representing a specific non-limiting embodiment of the invention.
Figure 6:
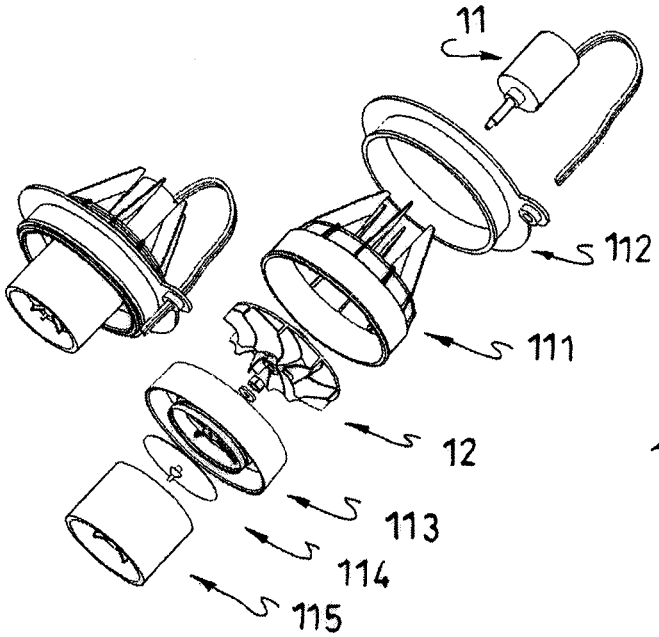
FIG. 6 an exploded perspective view of the components of FIG. 5.
Figure 7:
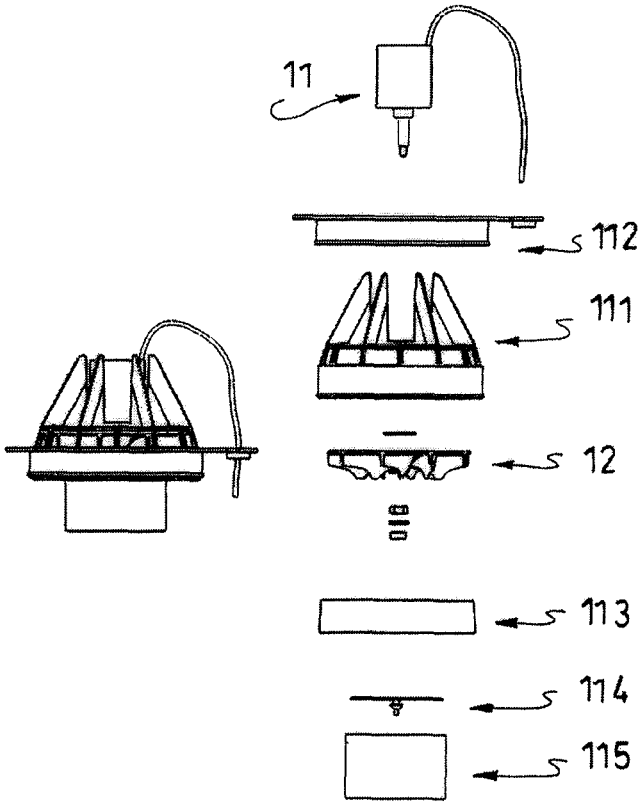
FIG. 7 is an exploded side view of the components of FIG. 6.

FIGS. 5, 6, and 7 are directed to a specific, yet non-limiting, embodiment of the invention. FIG. 5 illustrates a motor 11, to which a bladed rotor 12 is attached, for drawing in ambient air to an airbag through a dual source ducting arrangement (similar to that of FIG. 3). A flange 112 mounts the motor 11 and certain associated components to the airbag 31, a cut-away portion of the airbag being shown for convenience in FIG. 5. Adhesive or mechanical fastener(s) can be used, if necessary, to secure the flange to the airbag if determined to be advantageous or necessary. The flange 112 is shown with a wiring port through which the electrical connection extends between the digital speed controller and the motor.

FIGS. 5-7 identify the details of specific components of an exemplary embodiment for carrying out the invention. These details are presented only for the purpose of enhancing an understanding of the invention, although the scope of the invention is not limited to such details, nor are the details shown and described in FIGS. 5-7 intended to represent essential elements nor essential limitations of the invention.

As an example, FIG. 5, illustrates an assembly schematic of centrifugal avalanche airbag blower, showing power supply, digital control, ducting, and mounting to airbag. The assembly comprises:

- a battery 13 having the following features:
  - Lithium-ion polymer;
  - 1200 (100 g, 3 cell) to 1700 (200 g, 4 cell) mAh;
  - 11.1V or 14.8V;
  - Burst discharge 55 degrees C.;
  - 92 mm×35 mm×32 mm;
- a digital brushless speed controller 14 having the following features:
  - Constant current 40 A;
  - Max Current 50 A (10 s);
  - 35 grams;
  - 65 mm×25 mm×9 mm;
- a motor 11 secured on the avalanche airbag fabric 31, having the following features:
  - 3900 KV w/14.8 V or 5100 KV w/11.1V Brushless DC motor;
  - rpm=KV rating×battery voltage;
  - Voltage range: 6-14.8V;
  - Dimensions: 28 mm diameter×35 mm length;
  - 98 grams;
  - 3.17 mm shaft diameter;
  - 35 amp draw at maximum efficiency;
- an intake ducting 19 having the following features:
  - dual source ducting;
  - 2×to single 50 m I.D.

FIGS. 6 and 7 represent an exploded view of a centrifugal blower and motor for an avalanche airbag comprising:

- the motor 11 defined above;
- a motor mount/rotor casing 111 having the following features:
  - nylon 6.6;
  - heat guard for airbag fabric;
  - rotor blade guards;
- a mounting flange 112 having the following features:
  - Thermoplastic Polyurethane;
  - wiring port;
  - sews or welds to airbag;
  - blower assembly installed with circular clamp;
  - a rotor 12 having the following features:
  - fiber-reinforced nylon 6.6;
  - helical blade centrifugal rotor, 7- or 9-blade;
- a rotor casing/intake duct 113 having the following features:
  - nylon 6.6
  - 50 mm i.d. duct intake;
  - ball bearing bracket;
- a diaphragm check valve 114 made in silicone;
- a check valve housing 115 made in nylon 6.6.

In this regard, for example, the invention illustratively disclosed herein—with regard to FIGS. 5-7 as well as with regard to the invention shown in the other drawing figures and described elsewhere herein—suitably may be practiced in the absence of any element which is not specifically disclosed herein.

Finally, although the invention has been described with reference to particular means, structures, materials, and embodiments, it is to be understood that the invention is not limited to the particulars explicitly disclosed and extends to all equivalents within the scope of the claims.

The invention claimed is:

1. An airbag system for rescue in snow or water comprising:

- at least one inflatable airbag having an inflated state and a deflated state;
- a powered air mover; and
- a supporting device designed to support the at least one inflatable airbag and the powered air mover on a user of the airbag system or on equipment used by the user;
- the supporting device comprises a backpack having an upright panel configured to be supported against a user's back;
- in the deflated state, the supporting device being structured and arranged such that the at least one airbag is positioned within the supporting device;
- in the inflated state, the at least one airbag being structured and arranged to extend externally beyond the supporting device; and
- in the inflated state, a majority of the at least one airbag extending forwardly of the upright panel.

2. An airbag rescue system according to claim 1, wherein:

- the supporting device comprises a backpack having shoulder straps, the backpack supporting at least the at least one airbag and the powered air mover;
- in the deflated state, the at least one airbag is contained within the backpack.

3. An airbag rescue system according to claim 1, further comprising:

- at least one ambient air intake positioned on an outer surface of the supporting device.

4. An airbag rescue system according to claim 3, further comprising:

ambient air intake ducting positioned to channel ambient air from the at least one ambient air intake to the powered air mover.

5. An airbag for rescue in snow or water comprising:

at least one inflatable airbag having an inflated state and a deflated state;

a powered air mover comprising a means for inflating the at least one airbag with 100% ambient air to a volume of at least 100 liters in no more than 5 seconds; and a supporting device comprising a backpack having shoulder straps, the backpack being designed to support the at least one inflatable airbag and the powered air mover on a user of the airbag system;

the backpack comprising an upright panel configured to be supported against a user's back; and in the deflated state, the at least one airbag being contained within the backpack;

in the inflated state, the at least one airbag being structured and arranged to extend externally beyond the supporting device; and in the inflated state, the at least one airbag extending forwardly of the upright panel.

6. An airbag system according to claim 1, wherein:

the supporting device comprises structure to support the at least one airbag respectively in the deflated state and in the inflated state;

in the inflated state, the at least one airbag comprises at least a portion designed to be positioned proximate the user's head at the height of the user's head.

7. An airbag rescue system according to claim 1, wherein:

the powered air mover comprises:

a bladed rotor;

an electric motor; and a battery connected to the electric motor for powering the electric motor for rotating the bladed rotor.

8. An airbag rescue system according to claim 7, wherein:

the supporting device supports the battery as well as the electric motor and the at least one airbag.

9. An airbag rescue system according to claim 1, wherein:

the powered air mover further comprises:

a battery;

a controller connected to the battery and the powered air mover, the controller being configured to control power to powered air mover.

10. An airbag rescue system according to claim 9, further comprising:

a manual activation switch in communication with the controller, the switch being configured to be manipulated by the user and, via the controller, to selectively switch power to the powered air mover between off and on states.

11. An airbag rescue system according to claim 1, wherein:

the airbag rescue system includes neither a compressed gas container nor a source of compressed gas.

12. An airbag rescue system according to claim 7, wherein:

the electric motor has a weight of a fraction of a pound.

13. An airbag rescue system according to claim 12, wherein:

the electric motor has a weight of no more than 98 grams.

14. An airbag rescue system according to claim 1, wherein:

in the inflated state, the at least one airbag is configured to extend at a height of the user's head on both sides of the user's head.

15. An airbag rescue system according to claim 1, wherein:

the supporting device comprises a backpack; and the powered air mover is substantially centered, left-to-right, in relation to the backpack.

16. An airbag rescue system according to claim 1, wherein:

the supporting device comprises a backpack; and the backpack includes a main compartment for housing the airbag in the deflated state, in addition to other pockets.

17. An airbag system for rescue in snow or water comprising:

at least one inflatable airbag having an inflated state and a deflated state;

a powered air mover; and a supporting device designed to support the at least one inflatable airbag and the powered air mover on a user of the airbag system or on equipment used by the user;

in the deflated state, the supporting device being structured and arranged such that the at least one airbag is positioned within the supporting device;

in the inflated state, the at least one airbag being structured and arranged to extend externally beyond the supporting device;

in the inflated state, at least a majority of a volume of the at least one airbag extends above the powered air mover; and in the inflated state and in an upright position of the airbag system when supported on the user, a majority of the volume of the at least one airbag is positioned above a top of the supporting device.

* * * * *